US007500828B2

(12) United States Patent
Landis

(10) Patent No.: US 7,500,828 B2
(45) **Date of Patent: *Mar. 10, 2009**

(54) AIRFOIL HAVING POROUS METAL FILLED CAVITIES

(75) Inventor: Kenneth K. Landis, Tequestra, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 405 days.

This patent is subject to a terminal disclaimer.

(21) Appl. No.: 11/183,134

(22) Filed: Jul. 15, 2005

(65) Prior Publication Data

US 2006/0285975 A1 Dec. 21, 2006

Related U.S. Application Data

(60) Provisional application No. 60/677,900, filed on May 5, 2005.

(51) Int. Cl.
*F01D 5/18* (2006.01)

(52) U.S. Cl. ..... 416/97 R; 416/1; 416/230; 416/241 R

(58) Field of Classification Search ..... 415/1, 415/115, 116; 416/1, 96 R, 96 A, 97 R, 97 A, 416/231 R, 241 R, 241 B, 229 A, 230
See application file for complete search history.

(56) References Cited

U.S. PATENT DOCUMENTS

| | | | | | |
|---|---|---|---|---|---|
| 3,240,468 | A * | 3/1966 | Watts et al. | ..... | 416/97 R |
| 3,468,513 | A * | 9/1969 | Schmitz | ..... | 416/97 R |
| 3,695,778 | A * | 10/1972 | Taylor | ..... | 416/96 R |
| 4,118,146 | A * | 10/1978 | Dierberger | ..... | 416/97 A |
| 4,629,397 | A | 12/1986 | Schweitzer | | |
| 6,412,541 | B2 * | 7/2002 | Roesler et al. | ..... | 164/34 |

* cited by examiner

*Primary Examiner*—Christopher Verdier
(74) *Attorney, Agent, or Firm*—John Ryznic

(57) ABSTRACT

A turbine airfoil used in a gas turbine engine includes a plurality of cavities opening in a direction facing the airfoil surface, each cavity having cooling holes communicating with an internal cooling fluid passage of the airfoil, and the airfoil surface above the cavity being a thermal barrier coating and having a plurality of cooling holes communicating with the cavity, where each cavity is filled with a porous metal or foam metal material. Heat is transferred from the airfoil surface to the porous metal, and a cooling fluid passing through the porous metal attracts heat from the porous metal and flows out the holes and onto the airfoil surface to cool the airfoil.

11 Claims, 1 Drawing Sheet

AIRFOIL HAVING POROUS METAL FILLED CAVITIES

CROSS-REFERENCE TO RELATED APPLICATIONS

This application claims the benefit to an earlier Provisional Application Ser. No. 60/677,900 filed on May 5, 2005 and entitled Airfoil Having Porous Metal Filled Cavities.

BACKGROUND OF THE INVENTION

1. Field of the Invention

The present invention relates to an airfoil for use in a gas turbine engine, either as a blade or a vane, in which the airfoil includes a plurality of porous metal filled cavities with a thermal barrier coating applied over the porous metal, the porous metal allowing cooling air to flow through it onto the TBC producing a cooling air film to cool the airfoil.

2. Description of the Related Art Including Information Disclosed under 37 CFR 1.97 and 1.98

Prior art airfoils use a variety of ways to cool the airfoil using cooling air passing through and over the surface of the airfoil. U.S. Pat. No. 4,629,397 issued to Schweitzer on Dec. 16, 1986 shows an airfoil (FIG. 4) having a plurality of unobstructed cooling ducts 3 and lands 5 enclosed by an inner layer of metal felt 4 and an outer layer of heat insulating ceramic material 6 which partially penetrates into the metal felt 4 to form a bonding zone between the felt 4 and the ceramic material 6. Thus, any heat passing through the ceramic layer 6 is introduced into the large surface area of the metal felt 4 enabling the latter to efficiently introduce the heat into a cooling medium flowing in the ducts 3, thereby preventing thermal loads from adversely affecting the metal core to any appreciable extent.

BRIEF SUMMARY OF THE INVENTION

The present invention provides an airfoil used in a gas turbine engine which includes a plurality of open ducts or cavities, these cavities being substantially filled with a porous metal material to allow cooling air to pass through the porous metal, and a thermal barrier coating (TBC) applied on top of the porous metal, the TBC having cooling air holes to allow for the cooling air passing through the porous metal to flow onto the outer surface of the TBC to cool the airfoil. Cooling holes are located in the base of the cavities and through the TBC to allow cooling fluid to flow from within the airfoil to the external surface of the TBC. The porous metal acts as a support for the TBC, and also provides improved heat transfer from the airfoil to the cooling air passing through the porous metal since the porous metal better dissipates the heat throughout itself. The porous metal also acts to spread out the flow of cooling air as the cooling air passes through the porous metal, thereby increasing the heat transfer effect.

DETAILED DESCRIPTION OF THE INVENTION

Figure 1:
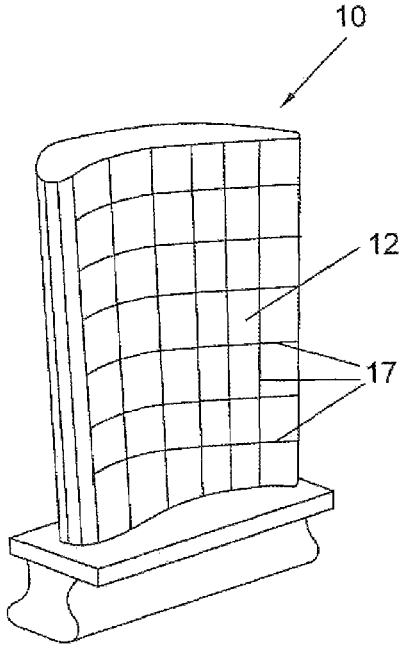
FIG. 1 shows a turbine airfoil having a pressure side with a plurality of square-shaped porous metal filled cavities.

A gas turbine engine includes airfoils within the direct the flow of gas passing through it and to remove power from flowing gas. The airfoil can be either a rotary blade or a guide vane. An airfoil 10 of the blade type is shown in FIG. 1 and includes a plurality of cavities 12 or ducts opening onto a surface of the airfoil. These cavities are formed by ribs 17 crossing each other that also act as rigid supports for the airfoil. The cavities in the present invention are shown as substantially rectangular in shape having equal length and width. However, any shape and size could be used under the principal of the present invention. The blade or vane includes an airfoil frame with an internal cooling air passage formed therein on the inner side of the frame, and an array of ribs on the outer side of the frame that form the cavities. The ribs separate each adjacent cavity from one another to prevent mixing of cooling air. The airfoil frame has a general shape of the airfoil with a leading and trailing edge and pressure and suction sides extending between the two edges.

Figure 2:
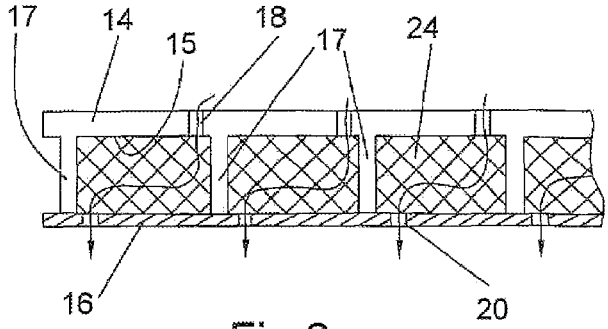
FIG. 2 shows a cross-sectional view of a surface of the airfoil with the cavity filled with a porous metal and a TBC applied over the porous metal.

FIG. 2 shows a cross-sectional view of the airfoil wall 14 having the cavities formed by the ribs 17. Each cavity is filled with a porous metal 24. The porous material substantially fills the cavity such that the TBC can be supported and that porous material extends between the rib side walls and the floor or base of the cavity so that the heat can be transferred from the metal to the porous material so that the cooling air passing through the porous material will produce an increased heat flux. The porous metal is sometimes referred to as a foam metal or a fiber metal. The base 15 of the cavity includes a plurality of cooling holes 18 to pass cooling air from a central passageway inside the airfoil 10 into the porous metal filled cavity 12. A thermal barrier coating (TBC) 16 is applied over the porous metal to form an outer surface of the airfoil. The porous metal 24 acts as an insulating layer and acts to support the TBC and well as provide increased heat transfer from the airfoil to the cooling air. The TBC also has a plurality of cooling holes 20 to allow for the cooling air to pass onto the outer surface of the airfoil 10. In this embodiment, the porous metal is of a low density with respect to other porous metals in order to allow cooling air to flow through the material for heat transfer purposes.

The cooling holes 18 in the base 15 of the cavity are located on an opposite side of the cavity 12 than the cooling holes 20 in the TBC in order to force the cooling air passing through the porous metal 24 to pass through as much of the porous metal 24 as possible, thereby increasing the heat transfer effect of the porous metal 24 to the cooling air.

Figure 3:
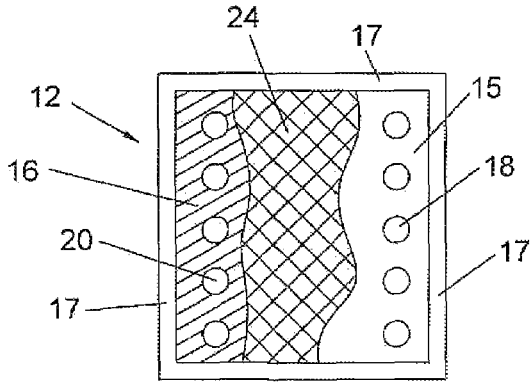
FIG. 3 shows one of the square-shaped cavities with a porous metal filling the cavity and a plurality of cooling holes in the base of the cavity and in the TBC applied over the porous metal.
Figure 4:
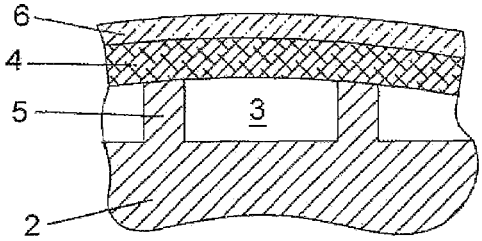
Fig 4 Prior Art
FIG. 4 shows a Prior Art airfoil with a porous metal and a Ceramic TBC layer from U.S. Pat. No. 4,629,397.

FIG. 3 shows a single cavity of the present invention in which the base 15 of the cavity includes a plurality of cooling holes 18 arranged along one side of the cavity 12. The cavity 12 is filled with the porous metal 24, and the TBC 16 is applied over the porous metal 24. Cooling holes 20 in the TBC are placed on an opposite side of the cavity 12 from the cooling holes 18 in the base 15 in order to force the cooling air to pass through as much of the porous metal as possible.

The porous metal used in the present invention can be any of the well-known porous metals used in gas turbine engines. The preferred material would be one that has a high melting point, and a high conductivity to magnify the effective cooling passage heat transfer coefficient at high temperatures found in the gas turbine art.

The size and shape of the cavities can be varied to provide any desired heat transfer effect. Cavity shapes can be square as shown in the Figures, rectangular, triangular, or even oval. The depth to width ratio of the cavity would depend upon the strength required for the side walls to support. TBCs having high strengths can be supported by larger cavities. The packing density of the porous metal can be regulated or varied within the airfoil to effect heat transfer rates. Even the relative density of the porous metal within a cavity can be varied to affect the heat transfer rate. Providing a higher density of porous metal at the interface of the TBC will improve the strength of the porous metal to secure the TBC.

What is claimed is:

1. A turbine airfoil for use in a turbine of a gas turbine engine, the turbine airfoil comprising:

An airfoil frame having an airfoil shape with a leading edge and a trailing edge and a pressure side and a suction side extending between the leading and the trailing edges, the airfoil frame forming an internal cooling air supply passage;

The airfoil frame includes an array of ribs forming a plurality of cavities on the outer side of the airfoil frame;

A cooling air supply hole in the base of each cavity connected to the internal cooling air supply passage to supply cooling air to the respective cavity;

A porous metallic material substantially filling each cavity;

A TBC secured to the porous metallic material and the ribs to form an outer airfoil surface; and, A film cooling hole formed in the TBC for each cavity to discharge film cooling air onto the airfoil outer surface.

2. The turbine airfoil of claim 1, and further comprising:

The film cooling hole for each cavity is offset from the base cooling hole such that the distance within the cavity from the base hole to the film hole is lengthened.

3. The turbine airfoil of claim 1, and further comprising:

The base for each cavity includes a plurality of cooling holes; and,

The TBC includes a plurality of film holes for each cavity.

4. The turbine airfoil of claim 3, and further comprising:

The cooling holes in the base are located adjacent to one side of the cavity and the film holes in the TBC are located adjacent to an opposite side of the cavity.

5. The turbine airfoil of claim 1, and further comprising:

The porous metallic material is of a low density such that heat is transferred from the airfoil surface into the porous metallic material, and then from the porous metallic material into cooling air flowing through the cavity.

6. The turbine airfoil of claim 1, and further comprising:

The plurality of cavities form an array on the pressure side of the airfoil frame.

7. The turbine airfoil of claim 6, and further comprising:

The plurality of cavities are substantially rectangular in shape.

8. The turbine airfoil of claim 6, and further comprising:

A plurality of cavities also formed on the suction side of the airfoil frame.

9. The turbine airfoil of claim 6, and further comprising:

The cavities on the pressure side of the airfoil frame extend from the leading edge region to the trailing edge region of the airfoil.

10. The turbine airfoil of claim 1, and further comprising:

The airfoil frame, the ribs, the base for each cavity and the internal cooling air supply passage are all formed as a single piece.

11. The turbine airfoil of claim 1, and further comprising:

Each cavity includes base cooling holes and TBC film holes sized to regulate the heat flux for each cavity based upon the heat load applied to the airfoil surface on that particular cavity.

* * * * *